United States Patent [19]

Stevens et al.

[11] 3,954,087

[45] May 4, 1976

[54] INTEGRAL SEPARATION START-UP SYSTEM FOR A VAPOR GENERATOR WITH VARIABLE PRESSURE FURNACE CIRCUITRY

[75] Inventors: William D. Stevens, North Caldwell; Walter P. Gorzegno, Morristown, both of N.J.

[73] Assignee: Foster Wheeler Energy Corporation, Livingston, N.J.

[22] Filed: Dec. 16, 1974

[21] Appl. No.: 533,389

[52] U.S. Cl. ..... 122/406 S; 122/406 ST; 122/479 S

[51] Int. Cl.[2] ..... F22B 29/12

[58] Field of Search ..... 122/406 R, 406 S, 406 ST, 122/479 R, 479 S

[56] References Cited

UNITED STATES PATENTS

| | | | |
|---|---|---|---|
| 3,021,824 | 2/1962 | Profos | 122/406 |
| 3,205,868 | 9/1965 | Schwarz | 122/406 |
| 3,212,477 | 10/1965 | Gerber et al. | 122/406 |
| 3,219,018 | 11/1965 | Augsburger | 122/406 |
| 3,358,450 | 12/1967 | Schroedter | 122/406 |
| 3,366,093 | 1/1968 | Stevens et al. | 122/406 |
| 3,464,393 | 9/1969 | Chambert | 122/406 |
| 3,556,059 | 1/1971 | Gorzegno et al. | 122/406 |
| 3,665,895 | 5/1972 | Sauter | 122/406 |
| 3,789,806 | 2/1974 | Gorzegno | 122/406 |

*Primary Examiner*—Kenneth W. Sprague
*Attorney, Agent, or Firm*—Marvin A. Naigur; John E. Wilson

[57] ABSTRACT

A vapor generating system for use in a power plant having a steam turbine and a condenser connected in a series flow relationship, in which a vapor generating section receives a heat exchange fluid and passes the fluid in a heat exchange relation to a source of heat to raise the temperature and pressure of the fluid to predetermined values, with a plurality of separators being in the main flow path in fluid flow communication with the tubes of the vapor generating section for receiving the fluid and separating the fluid into a liquid and a vapor. The separators are connected to a vapor circuit and to a liquid circuit for passing the vapor and liquid to the turbine and condenser, respectively. A method of starting up a vapor generating system in a power plant.

8 Claims, 4 Drawing Figures

PRIMARY SUPERHEATER
107
SPRAY
PLATEN SUPERHEATER
FINISHING SUPERHEATER
16
HIGH PRESSURE TURBINE
14
ROOF
100
102
104
106
108
113
TO DRAIN
HEAT RECOVERY AREA
98
12
112
REHEATER
94
66
LEVEL CONTROL UNIT
136
130
DRAIN COLLECTING HEADER
110
LOW PRESSURE TURBINE
131
72
62
10
132
FURNACE
22
134
ECONOMIZER
20
18
114
140
CONDENSER
144
142
DEMINERALIZER
120
118
DEAERATOR AND TANK
116
117
HOT WELL
126
122
LOW PRESSURE HEATERS
CONDENSER PUMP
124
HIGH PRESSURE HEATERS
FEED PUMP

INTEGRAL SEPARATION START-UP SYSTEM FOR A VAPOR GENERATOR WITH VARIABLE PRESSURE FURNACE CIRCUITRY

BACKGROUND OF THE INVENTION

This invention relates to a start-up system for vapor generators and in particular to an apparatus and method for starting up a sub-critical or super-critical, once-through vapor generator.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as superheated vapor for use in driving a turbine, or the like.

Although these arrangements provide several improvements over conventional drum-type boilers, some problems have arisen in connection with starting up the generators, usually stemming from fluid at an undesirable quantity or condition being passed to the components of the system, resulting in excessive thermal losses, as well as mismatching of temperature of the throttle steam to the turbine inlet causing a decrease in turbine component life.

Earlier attempts to solve some of these problems included arrangements providing bypass circuitry for a portion of the fluid at a point in the flow circuitry between the vapor generating and superheating sections and/or between the superheating section and the turbine during start-up to pre-cool a portion of the system yet avoid the possibility of fluid at an undesirable quantity or condition being passed to the turbine. However, these arrangements resulted in very poor heat recovery and, therefore, operated at a reduced thermal efficiency and, moreover, resulted in relatively unsuitable turbine throttle vapor conditions for rolling and bringing the turbine up to speed prior to loading.

Attempts to alleviate the latter problems included installing a division valve in the main flow path to divert flow to a bypass circuit including a flash tank separator located between the vapor generating section and the superheating section, or between a primary and finishing superheater in the superheating section. In these arrangements, the flash vapor from the separator is furnished to the superheating section or to the finishing superheater, and the drains from the separator are passed to a deaerator and/or high pressure heater. However, in these systems, the separator could often accomodate only a limited pressure, which was considerably less than the full operating pressure of the main pressure parts. Therefore, after start-up, when turbine demands approached pressures exceeding the design pressure of the separator, the separator had to be switched out of operation and flow to the turbine supplied directly from the main flow line upstream of the flash tank. However, this switch of flow often caused control difficulties and, in addition, caused a drop in enthalpy at the turbine since the flow source switched from a saturated vapor from the separator to a lower enthalpy water-vapor mixture from the main flow line. Therefore, in order to avoid pressure excursions and an uncontrolled significant temperature drop at the turbine throttle, the valve controlling flow to the turbine directly from the main flow line had to be opened very slowly, the firing rate had to be increased, and the separator outlet valve closed to slowly transfer the source of turbine steam from the separator to the main flow line. This, of course, resulted in a considerable expenditure of time and energy, and a considerable sophistication of controls.

Also, in these latter arrangements, when vapor formed in the separator in response to a start-up firing rate input, the vapor, in addition to flowing to the turbine, was routed to other areas of the system such as high pressure heaters and/or the condenser until a percentage of the final turbine load was achieved. Therefore, these arrangements required the use and operation of several valves which added to the labor and costs in the operation of the system.

Although it has been suggested to provide a separator directly in the main flow line, these arrangements have proven to be costly due to the fact that a relatively large, thick-walled separator, and associated components, have to be used. Also, the vapor initially forming in the separator is passed in a circuit bypassing the finishing superheater and the turbine during start-up, after which the flow is switched to the superheater and turbine, which also requires a control system utilizing a number of valves.

SUMMARY OF THE INVENTION

It is, therefore, an object of the present invention to provide a vapor generating system and method incorporating a start-up system which does not require the use of bypass circuitry incorporating a flash tank separator.

It is a further object of the present invention to provide a system and method of the above type in which a plurality of separators are utilized which together operate at full system pressure and thus eliminate the need for a relatively large, thick-walled separator, while enabling the turbine to be smoothly loaded at pressures and temperatures that constantly and gradually increase.

It is a still further object of the present invention to provide a system and method of the above type in which vapor initially forming in the separators is immediately passed in the main vapor circuit containing the superheater section and the turbine, to eliminate the controls and valves required to initially route the vapor elsewhere.

Toward the fulfillment of these and other objects, the system of the present invention comprises a vapor generating section capable of operating at variable pressure during start-up, and including a plurality of tubes for receiving a heat exchange fluid and passing the fluid in a heat exchange relation to a source of heat to raise the temperature and pressure of said fluid to predetermined values, a plurality of separators for receiving said fluid and separating said fluid into a liquid and a vapor; and vapor and liquid circuit means connecting said separators to said turbine and to said heat recovery means and to said condenser, respectively.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
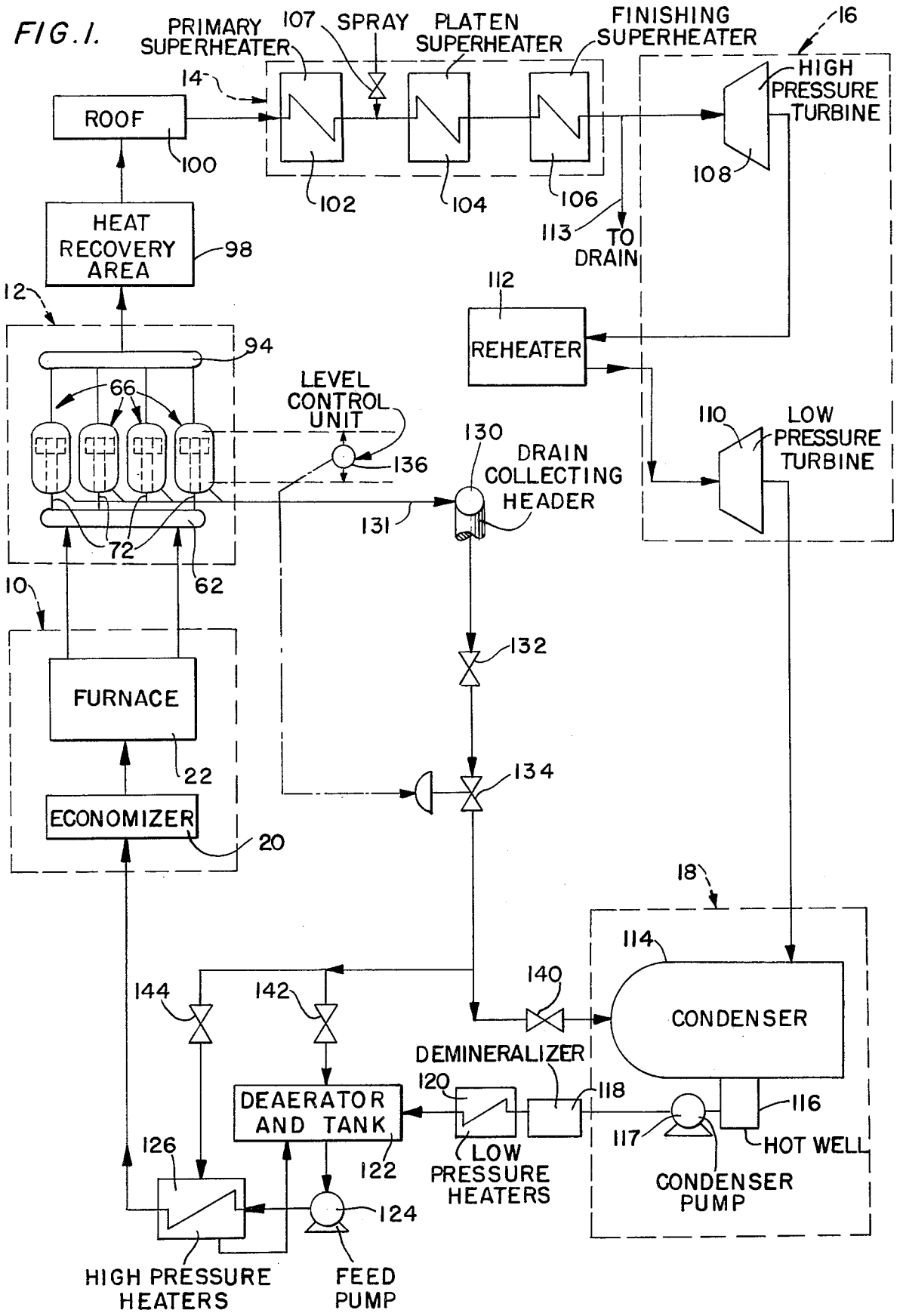
FIG. 1 is a schematic representation of a power plant incorporating the system of the present invention.

Referring specifically to FIG. 1, the reference numeral 10 refers in general to a vapor generating section which is connected in a series flow relationship with a collecting and separating section 12, a superheating section 14, a turbine section 16, and a condensing section 18. It is understood that the connections between these sections, which are shown schematically in the drawing, are achieved by fluid circuitry, in the form of conduits, tubes, risers, headers, etc., to transfer a heat exchange fluid either in a liquid form or a vapor form throughout the various sections, as will be described in detail.

The vapor generating section 10 consists of an economizer 20 adapted to receive the heat exchange fluid, which is preferably water, and pass it to a furnace section 22, after which it is passed to the collecting and separating section 12.

The furnace section 22 is of a two pass design and is of the type disclosed in U.S. Pat. No. 3,556,059, assigned to the same assignee as the present invention, with the disclosure of this patent hereby being incorporated by reference. The basic construction of the furnace section 22 as well as the collecting and separating section 12 is better described with reference to FIG. 2. In particular, the furnace section 22 is in the form of an upright rectangular enclosure 30 divided by front and rear walls 32 and 34, respectively, through which a plurality of burners, shown schematically by the reference numeral 36, extend. Two sidewalls 38 and 40 are connected to the front wall 32 and to the rear wall 34 to define the enclosure. As disclosed in the above patent, each of the walls 32, 34, 36, and 38 are made up of a plurality of vertically extending tubes having continuous fins extending outwardly from diametrically-opposed portions thereof, with the fins of adjacent tubes being connected together to form an airtight structure. The bottom end portions of the walls 32 and 34 are slanted inwardly as shown to form a hopper section 42, it being understood that a vestibule section and a convection section is provided adjacent the enclosure 30 and that a roof extends over all three sections, as described in the above patent.

A pair of inlet headers 44 and 46 are adapted to receive the water from the economizer 20 and are in registry with the lower ends of the tubes of the front wall 32 and the rear wall 34, respectively. A pair of outlet headers 48 and 50 are in registry with the upper ends of the tubes of the walls 32 and 34, with the tubes of the latter walls defining a first flow pass for the water entering the inlet headers 44 and 46. It is understood that suitable downcomers (not shown) are provided which are connected to the outlet headers 48 and 50 and which transmit the water from the latter headers to a plurality of inlet headers 58 and 60 which register with the lower ends of the tubes of the sidewalls 38 and 40, respectively. The fluid then flows in a second flow pass upwardly through the tubes of the walls 38 and 40 to upper outlet headers 62 and 64, respectively.

As a result of the foregoing, the water flows upwardly through the walls of the furnace 22 in essentially two vertically oriented flow passes connected in series, with each pass comprising a pair of opposed walls. In this manner, the tubes formed in each pass are in similar absorption zones and the flow through each wall of each pass will thereby be subjected to substantially the same input from the burners 36. As a result of this type of two-pass flow, the furnace is capable of variable pressure operation during start-up, as will be described in detail later.

Figure 2:
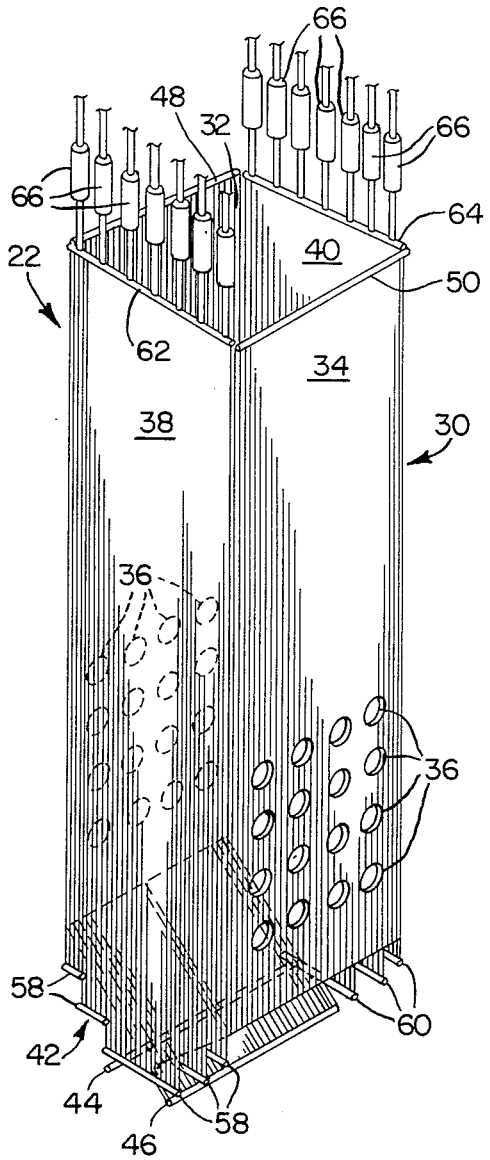
FIG. 2 is a schematic perspective view illustrating the furnace circuits and construction of the furnace section and separators used in the system of FIG. 1.

Referring to FIGS. 1 and 2, a plurality of separators 66 are connected to the outlet headers 62 and 64 to form the separators and collection section 12. The separators 66 extend in a spaced parallel relationship along the headers, with the number of separators corresponding to the number of riser tubes routing from the respective walls 38 and 40.

Figure 3:
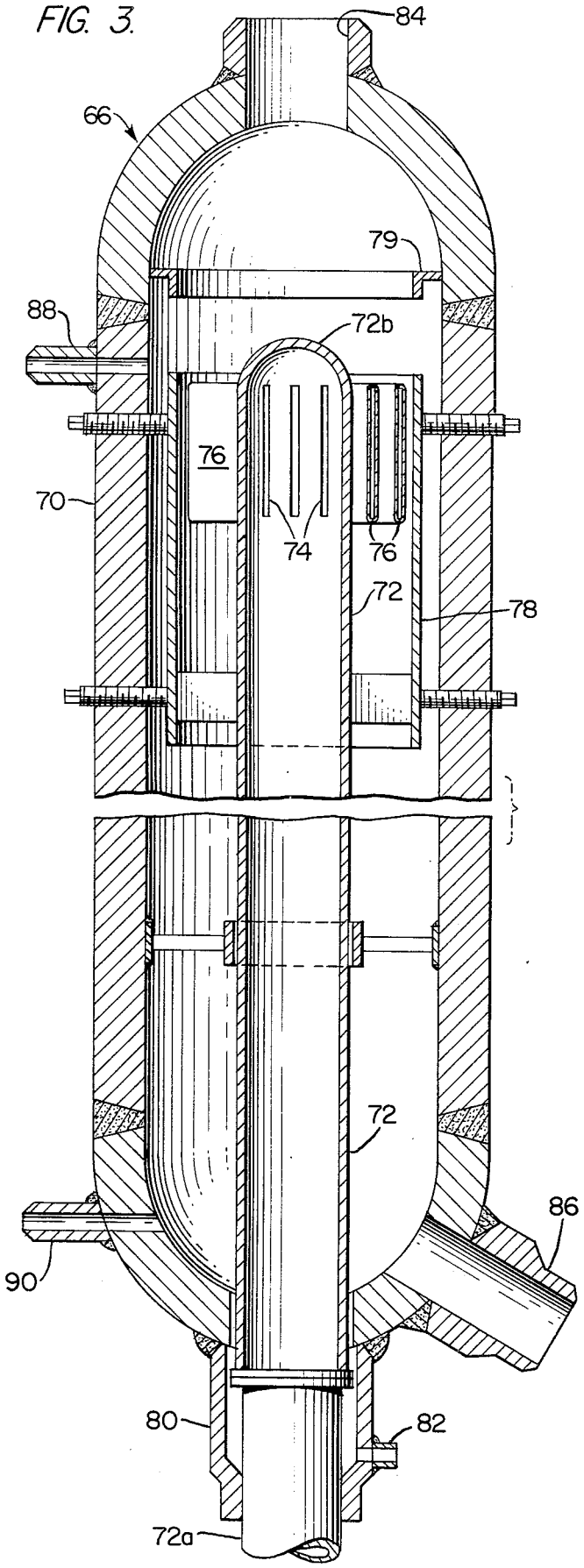
FIG. 3 is a vertical cross-sectional view of a separator used in the system of FIG. 1.

A separator 66 is shown in detail in FIG. 3 and includes an upright cylindrical shell 70 through which a riser pipe 72 extends in a coaxial relationship. The riser pipe 72 has a portion **72*a* extending from the lower end of the shell which is adapted for registration with one of the headers 62 or 64. A cap 72*b* extends over the upper end of the pipe 72 and a plurality of slots 74 are formed through the upper wall portion of the pipe near the latter end. A plurality of substantially spiral shaped arms 76 are connected to the pipe 72 in registry with the slots 74** with the free ends of the arms being open to permit fluid to discharge therefrom.

A cylindrical, open-ended, skirt 78 extends within the shell 70 and around the upper portion of the riser pipe 72 in a coaxial relationship therewith, with the inner wall of the skirt being spaced a small distance from the free ends of the arms 76. Although not clear from the drawings, it is understood that the skirt 78 is supported relative to the shell 70 in the position shown in a conventional manner such as by the use of set screws or the like.

A drip ring 79 is disposed in the upper portion of the shell 70 above the arms 76, and a cup-shaped member 80 which functions as a thermal sleeve extends over that portion of the riser pipe 72 extending outwardly from the lower end of the shell 70 to define an annular passage which is in communication with an auxiliary drain 82.

A vapor outlet nozzle 84 is provided at the open end portion of the shell 70 and a radially extending drain water outlet 86 is provided near the lower end portion of the shell. Also, the shell 70 is provided with a high level connection 88 and a low level connection 90 disposed near the upper and lower end portions of the shell, respectively, for the purpose of maintaining predetermined water levels in the separators, as will be described later.

As a result of the above, when the fluid entering the lower end **72*a* of the riser pipe 72 from the headers 62 or 64 is in the form of a steam water mixture, it passes upwardly in the riser pipe and then radially outwardly from the pipe through the slots 74 and into the arms 76 where it will be directed tangentially against the inner wall of the skirt 78. This creates a vortex, or whirling stream, of fluid with the resulting centrifugal forces causing the vapor portion of the fluid to travel away from the inner wall of the skirt 78 and towards the center of the whirling stream, and pass upwardly by virtue of its buoyancy into the upper portion of the shell 70, from which it exits, via the outlet 84. The liquid, or water, portion of the mixture in the whirling stream collects on and flows down the inner wall of the skirt 78 until it falls off the wall, collects in the lower end of the shell 70 and drains from the connection 86** for passage to other portions of the system as will be described later.

Referring again to FIG. 1, the vapor from the outlet nozzles 84 of the separators 66 is passed into a collecting pipe 94 and then through a heat recovery area 98 and a roof 100 to the superheating section 14.

The superheating section 14 includes a primary superheater 102, a platen superheater 104 and a finishing superheater 106 all of which are connected in the vapor circuit in a series flow relationship in the vestibule section and the convection section of the vapor generating unit, as described in the foregoing identified patent. A spray unit 107 is located in the vapor circuit between the primary supeheater 102 and the platen superheater 104 to reduce the temperature of the vapor to required values before it is passed to the turbine section 16.

The vapor output from the finishing superheater 106 is adapted to be connected, via the vapor circuit, to the turbine section 16 which includes a high pressure section 108, and a low pressure section 110. A reheater 112, which is located in the aforementioned convection section, is connected between the high pressure turbine 108 and the low pressure turbine 110. The latter turbines are driven by the vapor from the finishing superheater 106 and the reheater 112 and are adapted to drive a generator or the like (not shown) in a conventional manner. A drain line 113 is connected to the vapor circuit between the finishing superheater 106 and the turbine 108 to enable the vapor circuit to be warmed prior to rolling of the turbine, as will be explained in detail later.

The output from the low pressure turbine 110 is connected to the condenser section 18 which includes a condenser 114, a hotwell 116, a hotwell pump 117, and a demineralizer 118. As a result, the exhaust vapor from the turbine section 16 is passed to the condenser 114 where it is condensed and passed to the hotwell 116, before being pumped by the pump 117 through the demineralizer 118 and to a plurality of external low pressure heaters shown in general by the reference numeral 120. A deaerator and tank assembly 122 is connected to the output of the low pressure heater 120 for receiving the condensate before it is circulated, via a feed pump 124, to high pressure heaters 126 to further heat the condensate before it is passed into the economizer 20 of the vapor generating section 10.

A drain collecting header 130 is connected to the drain water connection 86 of the separators 66 by a plurality of drain tubes represented by the line 131 to collect the water from the separators and pass same, via a water circuit, through an isolating valve 132 and to a control valve 134. A level control unit 136 is in operative relationship with the high level connection 88 and the low level connection 90 of separators 66 and controls the operation of the valve 134 to maintain the desired water level in the separators 66. Valves 140, 142, and 144 are disposed in portions of the circuit to selectively direct the water from the valve 134 to the condenser 114, the deaerator and tank assembly 122, and the high pressure heaters 126, respectively.

To effect a cold start-up, the system of the present invention operates as follows. The valve 132 is opened and valve 134 is placed in its automatic mode to control the water level in the separators 66. The feed pump 124 is actuated to establish a relatively low water flow rate, such as 15% of full capacity through the vapor generating section 10, and into the collecting and separating section 12. The water from the separators 66 then passes to the drain collecting header 130 and through the latter, into the water circuit, with the discharge from the header being controlled by the level control unit 136 and the valve 134 in response to the water level in the separators 66. The valves 142 and 144 are then selectively opened by automatic means to permit water flow to the deaerator and tank assembly 122, and/or the high pressure heaters 126, respectively, in accordance with particular design requirements, after which it is re-cycled to the vapor generating section 10. For cycle water clean-up, valve 140 is selectively opened to permit water flow to the condenser 114 and through the main condensate demineralizer 118.

The burners 36 in the furnace section 22 are placed into service at a relatively low firing rate, such as 10% of full capacity, which raises the temperature of the water circulating through the above-mentioned section, and, in addition, raises the pressure in the separators 66. When the temperature of the circulating water reaches a predetermined value, such as 450° F., the minimum flow established by the feed pump 124 is raised a predetermined amount, such as to 25% of full capacity.

The heat input is then further raised by controlling the firing rate of the burners 36 in the furnace section 22 to the extent that some vapor is generated and separated in the separators 66. This vapor is immediately passed through the vapor circuit including the heat recovery area 98, the roof 100, the superheating section 14, and into the drain line 113 to warm the vapor circuit. The heat input is further raised to produce sufficient vapor to enable the high pressure turbine 108 to be connected to the vapor circuit by suitable valves (not shown) and permit the turbine to be rolled and sychronized, with the spray unit 107 reducing the temperature of the vapor in the vapor circuit as necessary. Further increases in the heat input in the foregoing manner causes furnace, separator and throttle pressures to increase, with corresponding increases in the load on the turbine 38 until the pressure at the furnace section 22, and therefore the pressure at the separators 66 and turbine throttle, reaches approximately 3500 psi, with the turbine-generator at 25% of full load capacity.

It is understood that as the pressure at the separators 66 approaches 3000 psi, a separator pressure error override modifies the level control error signal to valve 134 when negative error (low level) is indicated. In this manner, proper operations of valve 134 is assured even as the level control signal becomes erratic in the 3000 to 3500 psi range. At 25% load, the valve 134 is closed by an appropriate control signal to eliminate further flow through the separator drain circuit.

The temperature, pressure and flow rate of the vapor to the turbine 16 is then further increased by appropriate firing of the burners 36, and appropriate pumping rate action until full capacity operation is achieved. The separators 66 accommodate full system flow and pressure, causing minimal pressure drop, about 5 psi, in the main line circuit.

Figure 4:
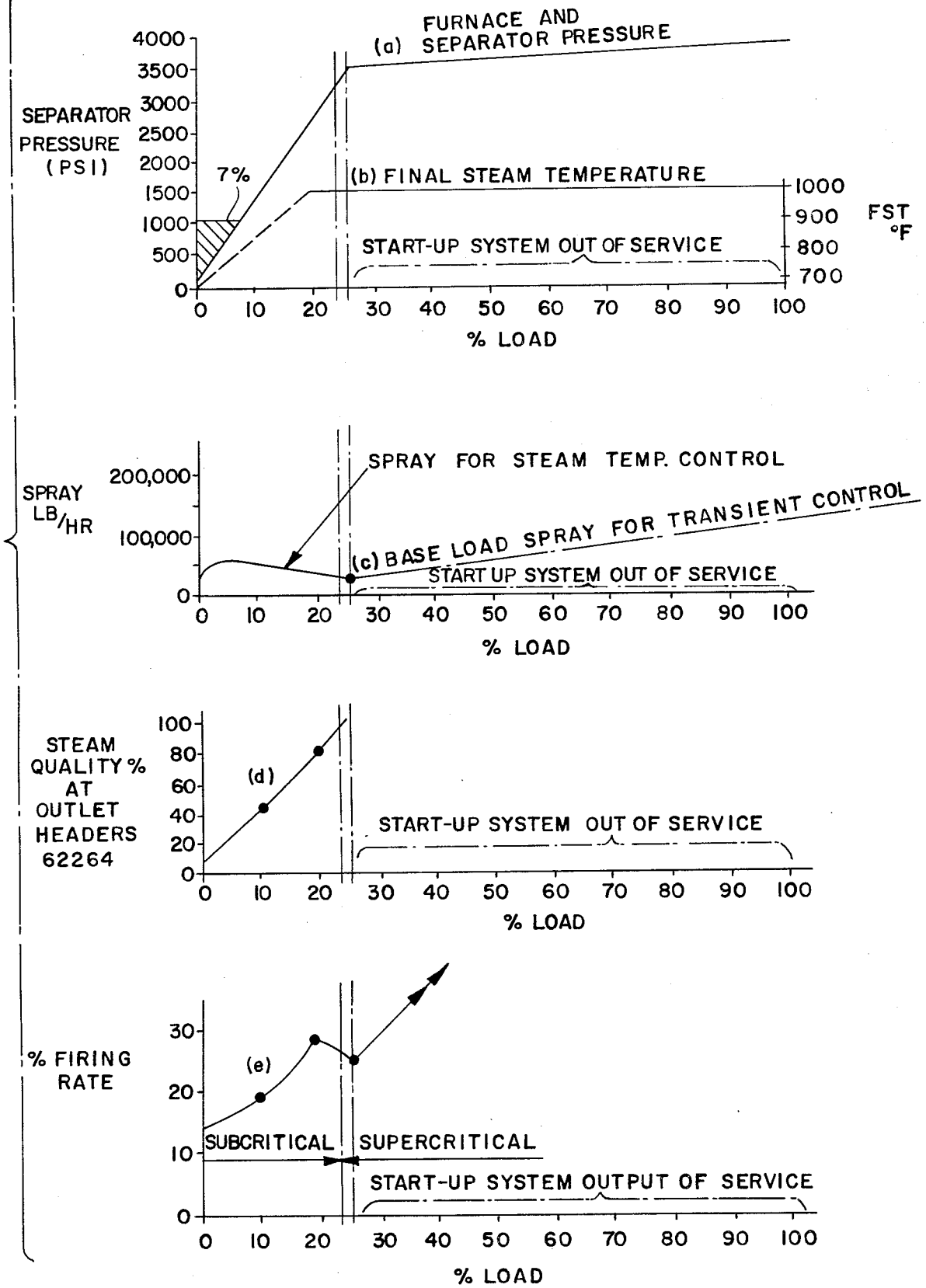
FIG. 4 is a series of operational curves derived in accordance with the system of the present invention.

The critical parameters involved in the above operation are depicted in FIG. 4 in which the following curves show the relation of the parameters indicated with load:

a. Furnace and separator pressure;
b. Final steam temperature;
c. Spray flow at spray unit 107;
d. Vapor quality (percent by weight vapor in the mixture) at outlet headers 62 and 64, and entering separators 66;
e. Percent firing rate input required to effect a start-up and continued loading of the system.

It is understood that at any stage of the above-described operation before the valve 134 is closed, the passage of the water from the latter valve to the condenser 114, the deaerator and tank assembly 122, and the high pressure heaters 126, can be selectively controlled by operation of the valves 140, 142, and 144, respectively, to selectively treat the water as described. It is also understood that the valve 132 is optional and is not absolutely necessary to the above operation.

It is thus seen that the system and method of the present invention enable a quick and efficient start-up to be achieved without the use of any external bypass circuit incorporating a separator. Also, the use of multiple separators enables full system pressure to be accommodated while the individual separators are relatively small in overall size (approximately 16 inches outside diameter) and wall thickness. As a result, the use of large, thick walled separators is eliminated. Further, since the level in the separators 66 in the arrangement of the present invention determines the division point during start-up, the system and method of the present invention enables the turbines to be smoothly loaded at optimum pressures and temperatures that can be constantly and gradually increased, and eliminates the boiler division valve as well as other controls and valves required to initially route the vapor in circuits other than the main vapor circuit.

Of course, other variations of the specific construction and arrangement of the system and method disclosed above can be made by those skilled in the art without departing from the invention as defined in the appended claims.

What is claimed is:

1. A start-up system for use in a power plant having a steam turbine and a condenser, said system comprising a vapor generator, means for establishing a main fluid flow path connecting said turbine, said condenser and said vapor generator in a series flow relationship, a plurality of separators connected in said main flow path between said vapor generator and said turbine, said separators adapted to accommodate the full operating load conditions of said vapor generator after start-up and to separate the fluid from said vapor generator into a vapor and a liquid during start-up, said vapor being passed in said main flow path to said turbine, means for establishing an auxiliary flow path extending out of said main flow path and connected to said separators for receiving the liquid from said separators during start-up, said auxiliary flow path including one branch flow line connected directly to said condenser and another branch flow line connected to said main flow path between said condenser and said vapor generator.

2. The system of claim 1 further comprising pump means for forcing said fluid through said main flow path and said auxiliary flow path, said pump means providing the sole means of fluid circulation during start-up and during full operating load conditions.

3. The system of claim 1 further comprising valve means associated with each of said branch flow lines for controlling the flow of liquid through said lines.

4. The system of claim 1 further comprising heat exchange means disposed in said main flow path between said condenser and said vapor generator, said other branch flow line being connected to said main flow path upstream of said heat exchange means.

5. A method of starting up a power plant having a turbine and a condenser, comprising the steps of connecting said turbine and said condenser in a main flow path with a vapor generator in a series flow relationship, passing fluid through said vapor generator to heat said fluid, connecting a plurality of separators in said main flow path between said vapor generator and said turbine so that said separators separate said fluid into a vapor and liquid during start-up and accommodate the full operating load conditions of said vapor generator after start-up, passing the vapor from said separators in said main flow path to said turbine, and selectively passing the liquid from said separators out of said main flow path directly to said condenser or back to said main flow path between said condenser and said vapor generator.

6. The method of claim 5 further comprising the step of pumping said fluid through said main flow path and said auxiliary flow path, said step of pumping providing the sole method of fluid circulation during start-up and during full operating load conditions.

7. The method of claim 5 further comprising the step of operating said vapor generator at variable pressures during start-up.

8. The method of claim 5 further comprising the step of heating said liquid in said main flow path between said condenser and said vapor generator.

* * * * *